United States Patent [19]

Dunavant

[11] 4,340,220

[45] Jul. 20, 1982

[54] AMUSEMENT DEVICE

[76] Inventor: John W. Dunavant, 388½ N. Saginaw St., Pontiac, Mich. 48058

[21] Appl. No.: 217,691

[22] Filed: Dec. 18, 1980

[51] Int. Cl.[3] ..... A63H 33/00; A63F 9/06

[52] U.S. Cl. ..... 273/1 GF; 46/131; 272/8 N

[58] Field of Search ..... 273/1 GF; 46/131; 272/8 N; 248/124–126, 218.4

[56] References Cited

U.S. PATENT DOCUMENTS

| | | | |
|---|---|---|---|
| 1,235,050 | 7/1917 | Pajeau | 46/131 |
| 1,305,512 | 6/1919 | Bax | 248/124 |
| 1,308,630 | 7/1919 | Hatch | 248/124 |
| 2,610,224 | 9/1952 | Norris | 248/218.4 X |
| 2,738,188 | 3/1956 | Hoffman | 272/8 N |
| 4,057,247 | 11/1977 | Morrison | 273/1 GF |

FOREIGN PATENT DOCUMENTS

| | | | |
|---|---|---|---|
| 563597 | 11/1932 | Fed. Rep. of Germany | 46/131 |
| 1058126 | 11/1953 | France | 46/131 |

OTHER PUBLICATIONS

Deltagram Magazine Nov–Dec. 1952, p. 116, Belt Balancing Hook.

*Primary Examiner*—Paul E. Shapiro
*Attorney, Agent, or Firm*—John W. Linkhauer

[57] ABSTRACT

A relatively simple device, capable of affording hours of amusement and fascination, comprises a pair of belt-balancing-hook members, each of said members having in a part thereof remote from said hook a bore passing through said member; a first rod member having in the vicinity of one end thereof an enlarged portion, said rod member being of such dimensions as to be snugly received within said bores, and a second rod member having in an end thereof a cavity within which an end of the first rod member may be received.

6 Claims, 7 Drawing Figures

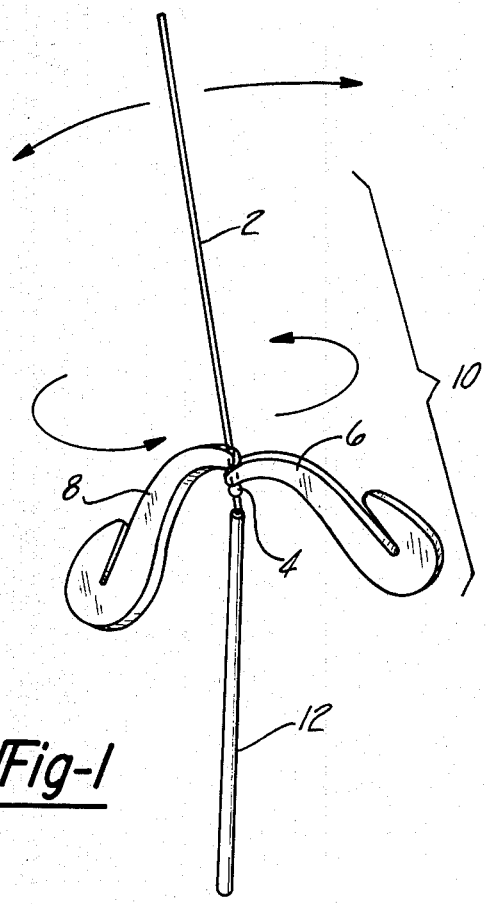
Fig-1
Fig-4
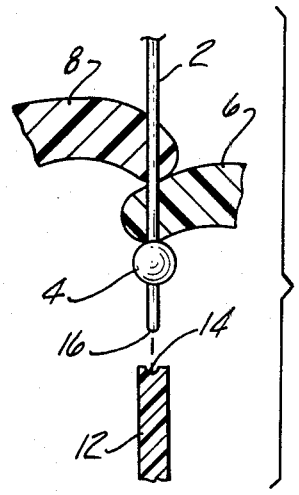
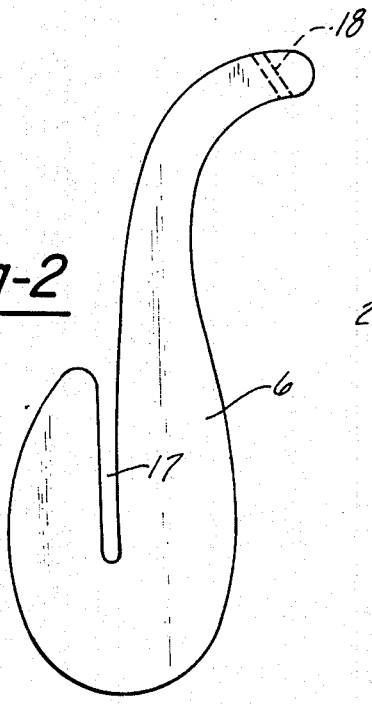
Fig-2
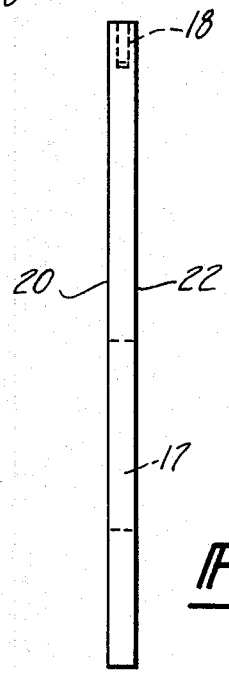
Fig-3
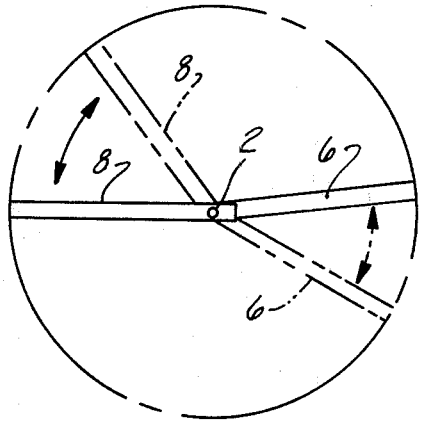
Fig-5

AMUSEMENT DEVICE

BACKGROUND OF THE INVENTION

1. Field of the Invention

This invention relates to an amusement device in the nature of a balancing toy suitable for use by children aged about five and up.

2. Description of the Prior Art

Belt-balancing hooks as such are well known in the art of balancing toys, examples of such hooks appearing in references such as the Bacon, Jr. U.S. Pat. No. Des. 225,347 and the article in Deltagram, Volume 21, No. 6, November-December 1952, page 116.

In the balancing-toy art, it is known (for example, from U.S. Pat. No. 497,081) to provide a toy of jointed construction, so that its distribution of weight and its consequent position of equilibrium may be altered.

The principle of providing a balanced structure which is of surprising stability because the center of gravity of the supported structure lies below the point of support (fulcrum) is illustrated in many references, including not only the belt-balancing-hook references mentioned above, but also British Pat. No. 210,179 and U.S. Pat. Nos. 2,190,800; 2,281,656; 3,613,300; and 3,623,239.

The prior art of which I am aware either shows a fingertip as being an equivalent of a stick or rod (as in, for example, U.S. Pat. No. 497,081 or British Pat. No. 210,179) or shows a stationary, vertically extending fulcrum (as in U.S. Pat. Nos. 2,190,800; 2,281,656; 2,724,210; 3,613,300; and 3,623,239). The prior art of which I am aware has not indicated the use of a hand-held stick or rod which has at the end distal from the hand a cavity or protuberance enabling it to be brought into sliding frictional contact with a second rod of stick having at its lower end a suitably co-operating configuration, so that there may be obtained both the effect of having the rods become approximately aligned (which enhances the apparent-gravity-defying effect) and the effect of making it possible to impart rotary motion to the supported rod and the members carried by it.

Moreover, the prior art of which I am aware does not indicate any structure which approaches the present invention in respect to providing both simplicity of structure and great variety of modes of operation and effect obtained. Either the structure is relatively complex and not relatively inexpensive to produce (as in U.S. Pat. Nos. 2,190,800; 2,281,656; 2,274,210; and 3,623,239) or the structure is relatively simpler, but at the same time, the relatively meager possibilities of the toy are a lot sooner exhausted (as in U.S. Pat. Nos. 497,081 and 3,613,300 and the above-mentioned British patent and belt-balancing-hook references).

SUMMARY OF THE INVENTION

A relatively simple device, capable of affording hours of amusement and fascination, comprises a pair of belt-balancing-hook members, each of said members having in part thereof remote from said hook a bore passing through said member; a first rod member having in the vicinity of one end thereof an enlarged portion, said rod member being of such dimensions as to be snugly received within said bores, and a second rod member having in an end thereof a cavity within which an end of the first rod member may be received.

DESCRIPTION OF THE DRAWINGS

A complete understanding of the invention may be obtained from the foregoing and following description thereof, taken in conjunction with the appended drawings, in which:

FIG. 1 is a perspective view of a toy in accordance with the present invention;

FIG. 2 is a front elevation view of a hook member which comprises a part of the toy illustrated in FIG. 1;

FIG. 3 is a side elevation view of the hook member illustrated in FIG. 2;

FIG. 4 is a detailed sectional view of a portion of the toy illustrated in FIG. 1;

FIG. 5 is a plan view, partly schematic, illustrating a further feature of the toy illustrated in FIG. 1;

DESCRIPTION OF THE PREFERRED EMBODIMENTS

Figure 6:
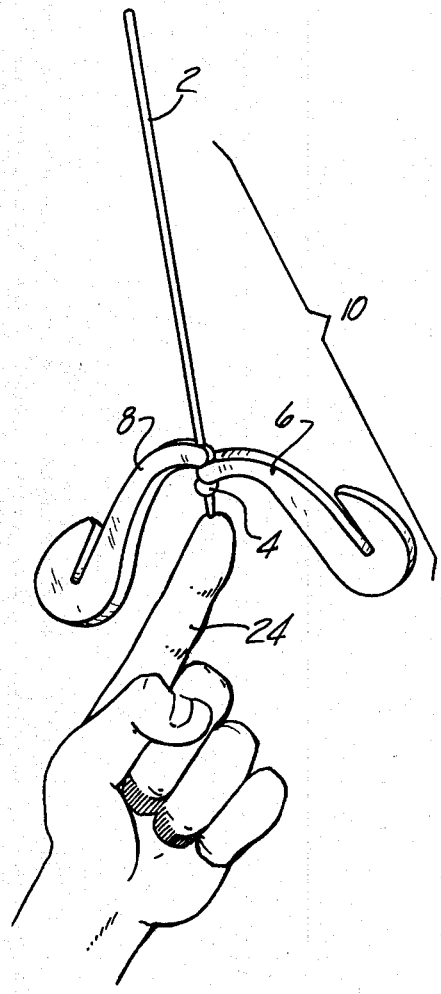
FIG. 6 is a perspective view, illustrating a first alternative way of supporting the balanced part of the toy illustrated in FIG. 1.

As shown in FIG. 1, in a preferred embodiment of the present invention, there is provided a toy which comprises a rod member 2 having near its lower end an enlargement or bulb 4 and having mounted thereon a first belt-balancing-hook member 6 and thereabove a second belt-balancing-hook member 8. The above-mentioned parts comprise the supported structure or balanced part 10 of the amusement device according to the invention. The balanced part 10 is supported, in accordance with a preferred embodiment of the invention, upon a support stick 12. As can be better seen in FIG. 4, the support stick 12 preferably has in its upper end a dimple or cavity 14, within which the lowermost end 16 of the rod member 2 may be received.

As shown in FIGS. 2 and 3, a belt-balancing-hook member 6 has located therein a slot 17 and has, passing through a part of the member 6 relatively remote from the slot 17 a bore 18, which is preferably of such dimensions that the member 6 may be snugly fitted onto the rod member 2. As may be seen in FIG. 3, the bore 18 is preferably located so that its axis runs parallel to the front and rear faces 20 and 22 of the member 6. For the sake of simplicity, it is preferred that the hook member 8 be substantially identical to the hook member 6, but those skilled in the art will appreciate that it will be possible, if desired, to obtain all the intended benefits of the present invention if there are used members 6 and 8 which are merely similar to each other, rather than being identical.

FIG. 4 is a detailed view, in which the halves of the support stick 12 and the members 6 and 8 which are nearest to the observer have been removed, those parts being shown in section. This makes it easy to observe the dimple or cavity 14 in the top end of the support stick 12, into which the lowermost end 16 of the rod member 2 projects. For clarity, the end 16 and the cavity 14 are shown as separated in FIG. 4.

FIG. 5 is a plan view in which there is shown the rod 2 in a direction parallel to its longitudinal axis, as well as, projecting outwardly therefrom and shown in solid lines, the hook members 6 and 8 in a first orientation thereof, namely, one in which they are substantially diametrically opposed, each to the other. FIG. 5 also shows, in broken lines, the members 6 and 8 in a second orientation with respect to each other. It is to be understood that the bore 18 in the hook member 6 and the corresponding bore in the member 8 are of such dimensions with respect to the rod member 2 that the latter is snugly received within the said bores, such that the person operating the amusement device according to the instant invention may, at will, cause the orientation to be varied, with results which will be discussed in greater detail hereinbelow.

Figure 7:
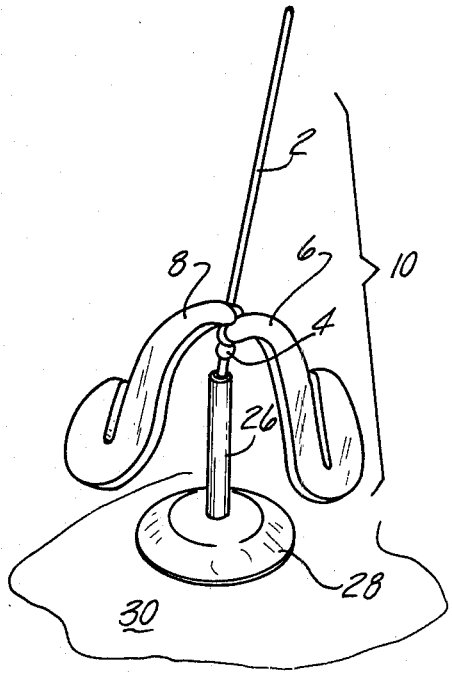
FIG. 7 is likewise a perspective view, illustrating a second alternative way of supporting the balanced part of the toy illustrated in FIG. 1.

FIGS. 6 and 7 are prespective views which illustrate alternative ways in which, in some circumstances, the supported part 10 of the amusement device according to the invention may be supported, i.e., without the use of the support stick 12. Thus, in FIG. 6, there is shown a mode of playing with the amusement device of the invention in which the supported part 10 is rested upon a finger 24. Other portions of the user's anatomy, such as the elbow, wrist, toe or nose, may likewise be used. FIG. 7 depicts an alternative in which the supported part 10 is rested upon a column 26 of a pedestal member 28, which may be supported upon any suitable flat surface 30, such as a tabletop or desktop.

MODES OF OPERATION

In a first manner of playing with the invention, one or both of the belt-balancing-hook members 6 and 8 are removed from the rod member 2 and used in the same way as the belt-balancing hooks known in accordance with the prior art.

In a second manner of playing with an amusement device according to the invention, the belt-balancing-hook members are placed upon the rod member 2 in such a manner that they are about as exactly opposite to each other as possible. That is to say, ideally a plane passing centrally through a first one 6 of the hook members and parallel to its flat front and rear faces would coincide with a similar plane passing centrally through a second one 8 of the hook members. With this positioning of the hook members 6 and 8, the rod 2 is placed upon the support stick 12, and the support stick 12 is twirled in one direction about its longitudinal axis. This causes twirling of the rod and hook members in the same rotational direction, but of course not necessarily at the same angular velocity, especially if the support stick 12 is initially twirled in one direction rather quickly. It is a matter of some amusement to see how quickly there is obtained a matching between the speed of twirling the support stick 12 and the corresponding speed of rotation of the rod and hook members.

In a third manner of playing with an amusement device according to the invention, there is the objective of achieving maximum rotational speed. In other words, an attempt is made to see how fast it is possible to make the supported structure spin. There is an opportunity, with practice, to gain skill at achieving a high rotational speed.

In accordance with a fourth manner of playing with an amusement device according to the invention, the supported part of the structure is set into rotation in one direction, clockwise or counterclockwise when viewed from above, and then the support stick is twirled in the opposite direction, and the person playing with the device of the invention then sees how long it takes to obtain a reversal in the direction of rotation of the supported part or a maximum speed in the reverse direction. As an extension of this same idea of using the support stick to cause reversal in the direction of rotation of the supported part, an attempt can be made to see, per minute, how many reversals of direction, and of what minimum magnitude (quarter-turn, half-turn, full 360-degree turn, or whatnot) can be obtained.

In a fifth manner of playing with the amusement device of the invention, the upper end of the rod is pushed away from its equilibrium poiition by a certain amount, and the person playing with the invention observes the time required for a steady state to return.

In a sixth manner of playing with the invention, the hook members are moved away from the "directly opposite" position by a certain amount, as in the directions of FIG. 5 hereinabove, and then an observation is taken, when the supported part is again mounted on the support stick, first, whether a balance can be achieved, and second, how far from the vertical and near to the horizontal the attitude of the rod 2 is. With about the maximum tolerable departure from "directly opposite" which will still give a balance, the rod 2 forms a relatively small angle with the horizontal, and then, by positioning the support stick 12 at a similar angle, so that it is rather roughly aligned with the rod 2, there is obtained rather a striking apparent-gravity-defying effect.

In a seventh manner of playing with the device of the invention, the hook members are placed approximately directly opposite, so that the rod member is nearly vertical, but the support stick is held at an angle as close to perpendicular to the rod as can be managed without losing support, either with or without twirling of the support stick.

In an eighth manner of playing with the device of the invention, the supported part 10 is taken, and preferably with the members 6 and 8 in substantially the directly-opposite position shown in solid lines in FIG. 5, an effort is made to balance the device upon the end of the support stick which is remote from the end 16. In other words, in this manner of playing with the supported part of the device of the invention, the supported part is "upside down" and in a position of unstable equilibrium.

Still other modes of deriving amusement from a device according to the invention may suggest themselves to a user thereof.

As one modification or equivalent which may be adopted in connection with the practice of the present invention, it is pointed out that in the embodiment of the invention depicted in FIGS. 1 to 4, inclusive, the upper end of the support stick 12 has a concave cavity or dimple 14, and the lowermost end 16 of the rod member 2 has a convex surface which fits therein, but in principle, all that is required is that the rod member 2 and the support stick 12 have suitably mating surfaces; that is to say, equivalent results may likewise be obtained with a rod member 2 having a concave cavity or dimple located in its lowermost end and a support stick 12 having at its uppermost end a convex portion such that it may be received within the aforementioned cavity or dimple in the rod member 2.

While I have shown and described herein certain embodiments of my invention, I intend to cover as well any change or modification therein which may be made without departing from the spirit and scope of the invention.

I claim as my invention:

1. An amusement device comprising a first elongated member of substantially circular cross-section, said member having near an end thereof an enlarged portion and at said end a non-planar surface, and first and second belt-balancing-hook members, each of said members having passing therethrough in a portion thereof distal from a hook portion of said member a bore of such dimensions as to permit said member to be fitted snugly over said first elongated member.

2. An amusement device as defined in claim 1, said device further comprising also a second elongated member, said member having at an end thereof a surface adapted to mate with said end of said first elongated member.

3. An amusement device as defined in claim 2, wherein said surface at said end of said second member is concave.

4. An amusement device as defined in claim 2, wherein said first and second belt-balancing-hook members have been fitted snugly over said first elongated member, the first of said belt-balancing-hook members being adjacent to said enlarged portion and the second of said belt-balancing-hook members resting against said first belt-balancing-hook member, said first and second belt-balancing-hook members extending away from said first elongated member in directions sufficiently close to being directly opposite to each other that a balance may be achieved when said first elongated member is oriented with said end thereof projecting downwardly and in mating contact with said end of said second elongated member.

5. An amusement device as defined in claim 1, said device further comprising pedestal means comprising an upstanding elongated member having in an end thereof a surface adapted to mate with said end of said first elongated member.

6. An amusement device as defined in claim 5, where said surface at said end of said pedestal member is concave.

* * * * *